US009731734B2

(12) United States Patent
Li et al.

(10) Patent No.: US 9,731,734 B2
(45) Date of Patent: Aug. 15, 2017

(54) METHOD FOR DETECTION OF A FLAW OR FLAWS IN A RAILWAY TRACK, AND A RAIL VEHICLE TO BE USED IN SUCH A METHOD

(75) Inventors: Zili Li, Delft (NL); Daniel Rixen, Delft (NL)

(73) Assignee: TECHNISCHE UNIVERSITEIT DELFT, Delft (NL)

( * ) Notice: Subject to any disclaimer, the term of this patent is extended or adjusted under 35 U.S.C. 154(b) by 583 days.

(21) Appl. No.: 14/342,096

(22) PCT Filed: Aug. 28, 2012

(86) PCT No.: PCT/NL2012/050586

§ 371 (c)(1),
(2), (4) Date: Jun. 10, 2014

(87) PCT Pub. No.: WO2013/032322

PCT Pub. Date: Mar. 7, 2013

(65) Prior Publication Data

US 2015/0291192 A1 Oct. 15, 2015

(30) Foreign Application Priority Data

Aug. 29, 2011 (NL) ..... 2007315

(51) Int. Cl.
*B61L 23/04* (2006.01)
*B61K 9/10* (2006.01)

(52) U.S. Cl.
CPC ..... *B61L 23/042* (2013.01); *B61K 9/10* (2013.01); *B61L 23/044* (2013.01); *B61L 23/045* (2013.01); *B61L 23/047* (2013.01); *B61L 23/048* (2013.01)

(58) Field of Classification Search
CPC .... B61L 23/044; B61L 23/042; B61L 23/045; B61L 1/06; B61L 23/04; B61L 23/047; B61L 23/048; G01M 17/08; B61K 9/10
See application file for complete search history.

(56) References Cited

U.S. PATENT DOCUMENTS 6,371,417 B1 * 4/2002 Southon ..... B61L 1/165 246/247
2007/0163352 A1 * 7/2007 Nielsen ..... B61K 9/10 73/668

FOREIGN PATENT DOCUMENTS

JP 2005 331263 * 12/2005
JP 2011 225188 * 11/2011
WO WO 00/76828 * 12/2000
WO WO 2011/019273 * 2/2011

OTHER PUBLICATIONS

English Translation of WO2000076828—Description section—DE2000001834, 2 pages, Dec. 2000.*

* cited by examiner

*Primary Examiner* — Mark Le
(74) *Attorney, Agent, or Firm* — Peacock Myers, P.C.; Jeffrey D. Myers; Justin R. Jackson

(57) ABSTRACT

Rail vehicle (1) having rail wheels (3,4) accommodated to guide the rail vehicle along a railway track (2) and said vehicle comprising means for detection of a flaw or flaws in the railway track, wherein the rail vehicle is provided with a noncontact vibrometer (9,10) which is arranged to measure vibrational movement of the railway track surface.

2 Claims, 1 Drawing Sheet

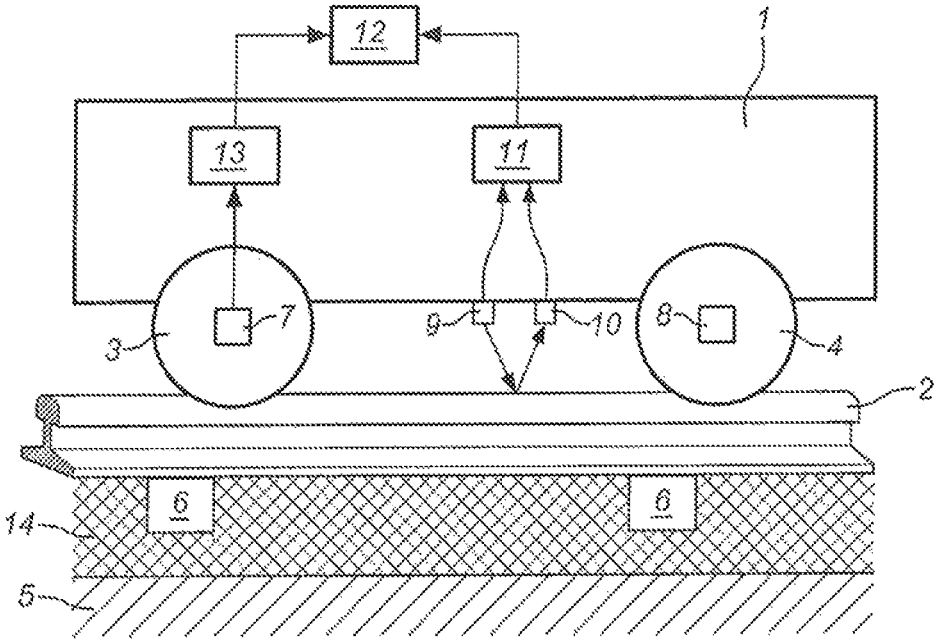
12
1
13
11
7
9
10
8
3
4
2
6
6
14
5

METHOD FOR DETECTION OF A FLAW OR FLAWS IN A RAILWAY TRACK, AND A RAIL VEHICLE TO BE USED IN SUCH A METHOD

CROSS-REFERENCE TO RELATED APPLICATIONS

This application claims priority to and the benefit of the filing of Patent Cooperation Treaty Application No. PCT/NL2012/050586, filed on Aug. 28, 2012, which claims priority to Netherlands Patent Application No. 2007315, filed on Aug. 29, 2011, and both applications are incorporated by reference herein in their entireties.

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable.

INCORPORATION BY REFERENCE OF MATERIAL SUBMITTED ON A COMPACT DISC

Not Applicable.

STATEMENT REGARDING PRIOR DISCLOSURES BY THE INVENTOR OR A JOINT INVENTOR

Not Applicable.

COPYRIGHTED MATERIAL

Not Applicable.

BACKGROUND OF THE INVENTION

Field of the Invention (Technical Field)

The invention relates to a method for detection of a flaw or flaws in the railway track, and to a rail vehicle to be used in such a method.

Description of Related Art Including Information Disclosed Under 37 C.F.R. §§1.97 and 1.98

A method for detection of rail top defects in a rail-way track by measuring an axle box acceleration signal of the rail vehicle is known from the Dutch patent NL 2 003 351. Such rail top defects are local short vertical geometrical deviations that may cause impact between the rails of the railway-track and the rolling wheels of a rail vehicle. Unless repaired a light rail top defect or squat will grow into a moderate defect, and subsequently into a severe defect. Rail fracture and damages to its fastening, the rail pads, sleepers and ballast (or slab) may ultimately occur if no remedial action is taken.

The invention is concerned with dealing with a broader range of problems than only squats. Railway tracks have a superstructure and a substructure. The superstructure comprises rails, switches and crossings (S & C), insulated joints (IJ), fasteners, sleepers and ballast (or slab). Due to the interaction between the wheels of the train and the track, dynamic forces arise between the wheels and the rails. As a consequence thereof stresses and strains arise in and between the track components, resulting in wear, deformation, and eventually possibly breakdown of the railway superstructure due to (metal) fatigue.

Generally speaking, the dynamic forces cause that the quality and performance of the components and the track system as a whole degrades. The components which are subject to (gradual) degradation include the rails, the switches and crossings, the insulated joints, the rail pads, (loose and missing) fasteners, (damaged or hanging) sleepers. Also local poor ballast and slab quality is a concern.

It is an object of the invention to detect such degradation of the system so that the quality and performance of the components and the system can be restored.

It is a further object of the invention that the detection is performed as early as possible for at least three major reasons: securing safety, avoidance of disruptions and limiting costs. If, for instance, a degradation is detected too late so that a rail break takes place in the switches and crossings, it may lead to derailment and will cause the track to be unavailable for traffic. Passengers' safety is at risk, and passengers' travels will be disrupted or have to be rerouted. Such an unplanned and late repair also results in high costs.

US2007/163352 discloses a method for detection of a flaw or flaws in a railway track, whereby a rail vehicle with rail wheels accommodated to guide the rail vehicle along the railway track is moved along the railway track for exciting the railway into vibration, and wherein the vibrational movement of the railway track surface is measured with a noncontact vibrometer. Conventionally each of the wheels will be connected to the vehicle by an intermediate axle box providing a bearing for the wheels. The rail vehicle is further provided with said non-contact vibrometer which is arranged to measure the vibrational movement of the railway track surface.

BRIEF SUMMARY OF THE INVENTION

To promote the objects of the invention a method and a rail vehicle are proposed in accordance with one or more of the appended claims.

In a first aspect of the invention a rail vehicle is proposed wherein the axle box is provided with at least one accelerometer, and that analyzing means on or external of the vehicle are present for comparing railway track surface vibrations as measured with the noncontact vibrometer with vibratory signals from the at least one accelerometer.

Accordingly in the method of the invention the rail vehicle is moved along the railway track for exciting the railway into vibration so that the vibrational movement of the railway track surface can be measured with the noncontact vibrometer, and the railway track surface vibrations as measured with the noncontact vibrometer are compared with vibratory signals derived from an axle box accelerometer of the vehicle. Thus according to the method of the invention it is possible to automatically and continuously inspect and monitor the conditions of the track components and the superstructure as a whole, in an early, a medium and a severe stage of degradation, by monitoring the dynamic interaction of the vehicle wheels with the railway track and measuring the railway track responses.

According to the invention the noncontact vibrometer can in principle be mounted on any in-service rail rolling stock or on a specialised measuring vehicle. The vibrometer can be placed in any suitable location, notably on the vehicle itself, the bogie or the axle box. Being able to be installed on an in-service vehicle makes it non-intrusive—it does not require that other trains give way to it. The continuous and nonintrusive nature makes it ideal for monitoring and not missing fast developing degradations.

With this system and railway vehicle of the invention, and the method of its operation, the reliability and availability of the railway infrastructure can be very much improved. It also greatly reduces unsafe labor conditions of track inspectors, the work of whom can be avoided to a large extent.

The proposed method and railway vehicle invention is based on the insight that anomalies in the railway track will occur due to degradations caused by forces, stresses and strains in and between the components of the railway track, and that such forces, stresses and strains are eventually the result of the wheel-rail interaction. The degradations will cause the response of the components and the system to develop and deviate from their original response, depending on where and how the degradations have taken place. In this regard it is remarked that the different components in the track system are designed to fulfill their respective functions in the system with different stiffness, damping and wavelength characteristics. Correspondingly they exhibit different frequency contents and magnitudes in their responses. The states of the system and of the components can thus be assessed by a vibrational analysis of the responses, which develop in line with the degradation of the components and the interaction between these components, resulting in varying input-response relationships. By comparing the current states of the system and of the components as identified from the responses with the design/reference states, anomalies in the system and the components can be detected and identified.

It is found to be beneficial that the railway track surface vibrations as measured with the noncontact vibrometer are compared with vibratory signals derived from an axle box accelerometer of the vehicle. Correspondingly it is preferred that there are analyzing means, preferably on the vehicle, for comparing railway track surface vibrations as measured with the noncontact vibrometer with vibratory signals from at least one accelerometer of the vehicle's axle boxes. This improves the sensitivity, resolution, accuracy and reliability of detecting the degradation of the components and the system.

BRIEF DESCRIPTION OF THE SEVERAL VIEWS OF THE DRAWING(S)

The invention will hereinafter be further elucidated with reference to the drawing of a single FIGURE providing a schematic view of a vehicle according to the invention moving over a railway track.

DETAILED DESCRIPTION OF THE INVENTION

A vehicle 1 runs with a certain speed along a track 2 with or without anomalies. Dynamic wheel-rail interaction is excited because the moving wheels 3, 4 excite vibration of the rails 2, and the ground 5. If there is ballast 14 (or slab) this maybe excited into vibration as well. The discrete support of sleepers 6 supporting the rails 2 excites periodic vibration of said rails 2 with a passing frequency and its harmonics corresponding to the vehicle 1 speed and the sleeper 6 spacing. Certain short wave irregularities excite their respective vibration modes and the anomalies that have developed cause certain frequency contents to deviate from their normal modes.

The vibrations as can be monitored on the rail head surface of the rails 2 can be picked up by accelerometers (that are known per se and not explicitly shown in the FIGURE) at the axle boxes 7, 8, and by a noncontact vibrometer 9, 10 mounted on the vehicle 1, for instance at its underside. A particularly useful noncontact vibrometer is a laser Doppler vibrometer that is embodied with a transducer 9 for emitting a laser signal to the rail's top surface and a receiver 10 for receipt of the laser signal after reflection by the rail's top surface. It is noted however that this is simply one possible embodiment; it is also possible to implement the vibrometer with one single unitary transmitter/receiver. The signals thus derived are processed in computing means 11 to provide the vibrational measurements concerning the rail surface.

It is remarked that the axle box 7, 8 accelerometers may provide signals corresponding to vibrations of the bearing of the wheels and of the wheels 3, 4, dynamic compression of the wheel-rail contact, geometry irregularity of the wheel 3, 4 and rail 2 surfaces, as well as vibration of the track as also measured by the noncontact vibrometer 9, 10 mounted onto the vehicle 1. It is noted once again that this noncontact vibrometer may also be on the bogie or on the axle box. Preferably externally or on the vehicle 1 analyzing means 12 are present for comparing railway 2 track surface vibrations as measured with the noncontact vibrometer 9, 10 and determined by computing means 11, with vibratory signals from at least one accelerometer of an axle box 7, 8 which are processed by computing means 13. The analyzing means 12 may also include storage means enabling later processing of the measurement signals.

The dynamic wheelrail contact force can be derived from the axle box 7, 8 accelerometers after removal of the track vibration component and removal of the noise introduced by the vibration of the wheelset and possibly also of the bearings. The removal of the said noise can be achieved according to the method disclosed in NL 2 003 351. The track vibration components can be removed by making use of the measurement by the noncontact vibrometer 9, 10. In this way the instrumented vehicle 1 will perform a hammer-like test aimed at detecting trackflaws/anomalies/discontinuities at rail 2 such as frogs of switches and crossings, insulated joints and squats where broadband impact force arises at wheel-rail contact, with the wheels acting as the hammers. The vehicle 1 will further act as a track loading vehicle at a normal linear track with the wheel 3, 4 again being the actuator and the actuation frequency being the sleeper 6 passing frequency. At design track irregularities like those in switches and crossings, the situation will be a combination of both types of excitations. At anomalies in the railway 2 track the interaction between track components and between wheel 3, 4 and rail 2 are abnormal, causing deviation in their respective vibration modes. By comparing the respective vibration modes with their design values, the anomalies can be identified. The locations of any anomalies can be determined with an accompanying global positioning system.

The invention claimed is:

1. A rail vehicle having rail wheels accommodated to guide the rail vehicle along a railway track and said vehicle comprising means for detection of a flaw or flaws in the railway track, which rail vehicle is provided with a noncontact vibrometer which is arranged to measure vibrational movement of a railway track surface, wherein each of the wheels is connected to the vehicle by an intermediate axle box providing a bearing for the wheel, characterized in that said axle box is provided with at least one accelerometer and a comparator on or external to the vehicle compares railway track surface vibrations as measured with the noncontact vibrometer with vibratory signals from the at least one accelerometer.

2. A method for detection of a flaw or flaws in a railway track, the method comprising the steps of:

moving a rail vehicle along the railway track to excite the railway track into vibration;

measuring vibrational movement of a railway track surface with a noncontact vibrometer; and comparing railway track surface vibrations as measured with the noncontact vibrometer with vibratory signals derived from one or more axle box accelerometers of the vehicle.

* * * * *